US006790132B1

(12) United States Patent
Slaughter, Jr.

(10) Patent No.: US 6,790,132 B1
(45) Date of Patent: Sep. 14, 2004

(54) DRESSING BLOCK FOR WORK SURFACES

(76) Inventor: Gibbs M. Slaughter, Jr., 6657 E. Peden Rd., Fort Worth, TX (US) 76179

( * ) Notice: Subject to any disclaimer, the term of this patent is extended or adjusted under 35 U.S.C. 154(b) by 0 days.

(21) Appl. No.: 10/443,191

(22) Filed: May 22, 2003

Related U.S. Application Data

(60) Provisional application No. 60/382,303, filed on May 22, 2002.

(51) Int. Cl.[7] ..... B24B 1/00

(52) U.S. Cl. ..... 451/57; 451/523; 451/555

(58) Field of Search ..... 451/57, 58, 41, 451/553, 552, 555, 557, 558, 523, 524, 525, 354

(56) References Cited

U.S. PATENT DOCUMENTS

| | | | | | |
|---|---|---|---|---|---|
| 168,717 | A | * | 10/1875 | Bushell | 451/524 |
| 1,658,371 | A | * | 2/1928 | Degner | 125/1 |
| 1,931,718 | A | * | 10/1933 | Chormann | 451/557 |
| 1,979,689 | A | * | 11/1934 | Hoke | 451/48 |
| 2,120,483 | A | * | 6/1938 | Burger | 451/557 |
| 2,295,693 | A | * | 9/1942 | Seigh | 451/557 |
| 3,436,874 | A | * | 4/1969 | Betzler | 451/56 |
| 3,813,830 | A | * | 6/1974 | Hodge | 451/524 |
| 5,146,909 | A | | 9/1992 | Ruark et al. | |
| RE37,486 | E | | 12/2001 | Stanzione | |

* cited by examiner

*Primary Examiner*—Robert A. Rose
(74) *Attorney, Agent, or Firm*—Bracewell & Patterson, L.L.P.

(57) ABSTRACT

A dressing block for dressing or finishing a work surface has an abrasive surface with abrasive parallel ribs. The ribs of the dressing block are for slidingly engaging a work surface having a pattern of protuberances separated by intersecting recesses. The abrasive surface of the ribs and the grooves between the ribs slidingly engage the protuberances and the recesses to dress the work surface. The user slides the dressing block relative to the work surface in a first direction to engage a first set of the recesses. The user then slides the dressing block in a second direction to engage the second set of recesses.

1 Claim, 2 Drawing Sheets

DRESSING BLOCK FOR WORK SURFACES

RELATED APPLICATIONS

Applicant claims priority to the application described herein through a United States provisional patent application titled "Dressing Block for Non-skid Surfaces," having U.S. Patent Application Ser. No. 60/382,303, which was filed on May 22, 2002, and which is incorporated herein by reference in its entirety.

FIELD OF THE INVENTION

1. This invention relates in general to a surface treatment tool, and more particularly to a tool for treating work surfaces.

BACKGROUND OF THE INVENTION

Work surfaces often have a surface profile designed for traction. Sometimes the work surface profile provides traction even when the work surface is wet. Such a work surface is commonly used on the decks of boats, but can also used on surfaces and floors in factories, kitchens, around swimming pools, on wooden decks, and generally any surface that becomes slippery when wet.

These work surfaces can be made of plastic, ceramics, or epoxies like fiberglass, depending upon the environment of usage. In the case of boat decks, fiberglass work surfaces are typical due to the durability of the material. The pattern on the work surface typically has a plurality of protuberances that are separated by intersecting grooves or recesses. The protuberances and recesses commonly form a pattern that covers the work surface in sets of lateral and longitudinal rows and columns. Another pattern has recesses that intersect at angles, thereby defining a plurality of diamond shaped protuberances formed on the work surface.

The work surface may need finishing or dressing after replacing damaged portions of the work surface. Replacement of the damaged portion is typically achieved with a putty of fiberglass material that is smeared over the portion needing new surfacing after the damaged portion is removed. A mold having a matching pattern is pressed into the putty of repairing material for a desired amount of time. After the mold is removed, sometimes the replacement portion requires dressing or finishing to remove extra material, or make the replaced portion appear more similar to the surrounding portion of the work surface. Sometimes the surface is not as reflective, and sometimes there is a slight variation in the patterns due to the original surface being stretched by the installer of the work surface. The typical manner of dressing the replacement portions was either with folded sandpaper or a tool like a file that is used to dress or finish each row of protuberances individually.

SUMMARY OF THE INVENTION

A dressing block provides an apparatus to dress a work surface having a pattern of protuberances. The dressing block includes a block body. The block body has an abrasive surface for dressing the work surface. The block body also typically includes a portion that can be held or connected to during use. Parallel ribs are formed on the abrasive surface, and the ribs are also abrasive. The ribs are spaced apart so that the ribs slidingly engage the recesses or grooves between the protuberances of the pattern on the work surface.

In one embodiment, each of the ribs have oppositely facing inclined faces so that the portion of the rib extending into the recesses of the work surface is narrower than the portion closer to the base of the ribs. The inclined faces matingly engage the sides of the protuberances. The inclined faces extend from the base of the ribs to a surface that slidingly engages the recesses of the work surface between the protuberances.

The dressing block matingly engages parallel recesses between the protuberances of the work surface. The user then slides the dressing block along the parallel recesses. The abrasive surface of the dressing block engages the sides and the upper surface of the protuberances, and the recesses between the protuberances.

The dressing block can, as desired, be rotated so that ribs align with another set of parallel recesses that intersect the previously recesses. The method described above is then repeated.

BRIEF DESCRIPTION OF THE DRAWINGS

The novel features believed to be characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings.

DETAILED DESCRIPTION OF PREFERRED EMBODIMENT

Figure 1:
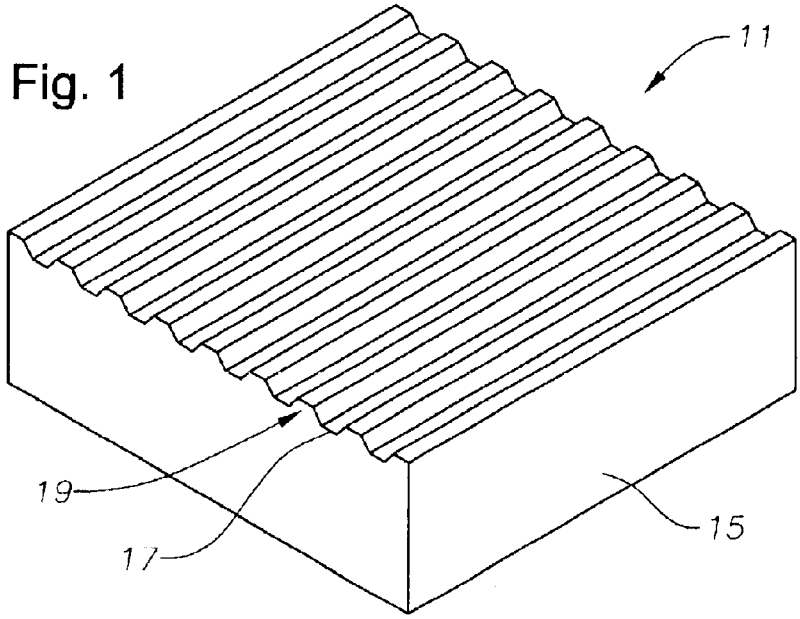
FIG. 1 is a perspective view of a dressing block constructed in accordance with the present invention.

FIGS. 1 shows a dressing, or sanding, block 11 for work surfaces of the type typically used on boat decks. A typical work surface is shown on deck 13 in FIG. 3.

Figure 2:
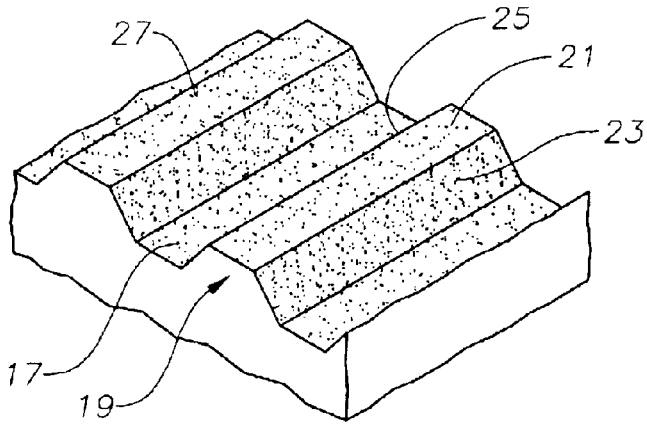
FIG. 2 is an enlarged view of a portion of the dressing block of FIG. 1.

Block 11 has a body 15 preferably formed from a rectangular billet of metal, such as steel. A series of recesses are formed in one surface of body 15 to form inner surfaces 17 and parallel ribs 19, these also being shown in the enlarged view of FIG. 2. Ribs 19 are formed on a generally planar work surface of block body 15. Body 15 has side edges and end edges that are orthogonal to the surface containing ribs 19. Ribs 19 extend completely from one side edge to another.

Figure 3:
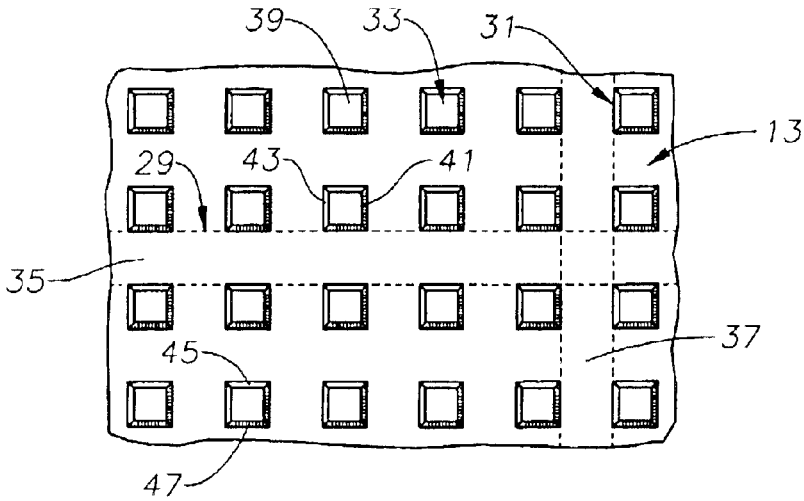
FIG. 3 is a top plan view of a portion of a work surface having a first surface pattern corresponding to the dressing block of FIG. 1.

In the embodiment shown, each rib 19 has a flat crest or outer surface 21 and opposing, inclined surfaces 23, 25 that extend from the lateral edges of the outer surface 21 to the lateral edges of grooves or inner surfaces 17. Inner surfaces 17 and outer surfaces 21 each have a width that corresponds to the width of upper and lower surfaces of a work surface (as shown in FIG. 3), and the inclination of surfaces 23, 25 match that of sidewalls of the work surface. The width of each inner surface 17 is the same as the witdh of each outer surface 21. Surfaces 17, 21, 23, 25 are encrusted with an abrasive 27 for sanding surfaces that are placed adjacent surfaces 17, 21, 23, 25. Abrasive 27 is preferably a diamond coating for providing surfaces 17, 21, 23, 25 with a tough, long-life abrasive 27. The grit size of abrasive 27 is preferably as large as 80 for sanding and as small as 2500 for polishing, though any desired grit size may be used.

The work surface of FIG. 3 is a square or rectangular diamond pattern created by forming a plurality of perpendicular recesses 29, 31 in deck 13. Recesses 29, 31 form pattern segments 33, lateral lower surfaces 35, and longitudinal lower surfaces 37, segments 33 being spaced apart from each other by surfaces 35, 37. Segments 33 comprise an upper surface 39, opposing inclined sidewalls 41, 43, and opposing inclined sidewalls 45, 47. Sidewalls 41, 43 extend from the longitudinal edges of upper surface 39 to the lateral edges of lower surface 37, whereas the sidewalls 45, 47 extend from the lateral edges of upper surface 39 to the longitudinal edges of lower surface 35.

Figure 4:
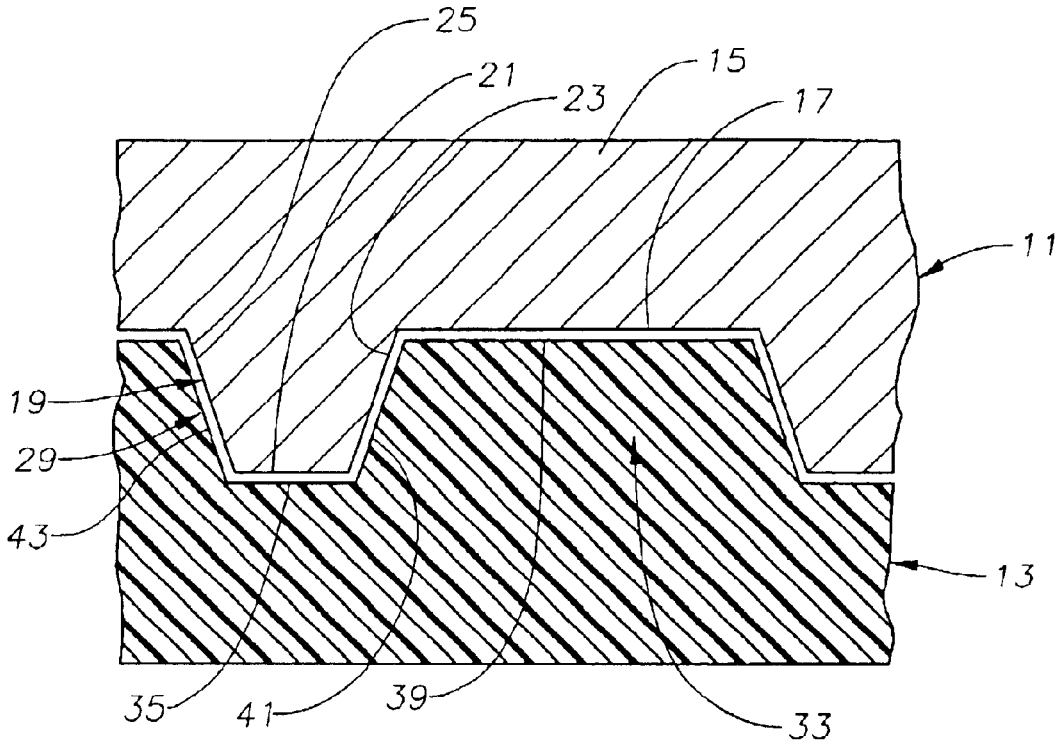
FIG. 4 is a cross-section view showing the dressing block of FIG. 1 engaging the work surface of FIG. 3.

FIG. 4 shows dressing block 11 inverted from the orientation shown in FIG. 1 and engaged with the surface pattern of deck 13. Ribs 19 of block 11 are located within recesses 29, and segments 33 are located within the recesses of body 15 and adjacent inner surfaces 17 of block 11. Each rib 19 engages deck 13 so that inclined surface 23 is adjacent sidewall 41, inclined surface 25 is adjacent sidewall 43, outer surface 21 is adjacent lower surface 35, and inner surface 17 is adjacent upper surface 39

Alternatively, dressing block 11 may be rotated 90 degrees about a vertical axis and positioned so that ribs 19 are located within recesses 31. In this orientation (not shown), each rib 19 engages deck 13 so that inclined surface 23 is adjacent sidewall 45, inclined surface 25 is adjacent sidewall 47, outer surface 21 is adjacent lower surface 37, and inner surface 17 is adjacent upper surface 39

Referring to FIGS. 1–4, in operation, dressing block 11 is formed by machining recesses in body 15 to form ribs 19 corresponding to the pattern of the work surface to be sanded. An abrasive coating 27 having a desired grit size is applied to outer surface 21, inclined surfaces 23, 25, and inner surface 17 for sanding surfaces placed adjacent surfaces 17, 21, 23, 25.

Dressing block 11 is then positioned on a deck 13 having a work surface requiring sanding. Block 11 is rotated to align ribs 19 with either of recesses 29, 31, and ribs 19 are inserted between segments 33 of the work surface, segments 33 locating within the recesses of dressing block 11. As described above, outer surfaces 21 are adjacent lower surfaces 35, inner surfaces 17 are adjacent upper surfaces 39, inclined surfaces 23 are positioned adjacent sidewalls 41, and inclined surfaces 25 are adjacent sidewalls 43.

Once dressing block 11 is positioned on deck 13, a user slides block 11 back and forth in a direction parallel to ribs 19 and the aligned lower surfaces 35 (in the orientation shown in FIG. 4). The direction of sanding motion in the orientation of FIG. 4 is normal to the plan of the figure. Abrasive 27 on surfaces 17, 21, 23, 25 shapes and smoothes surfaces 35, 39, 41, 43. Dressing block 11 is then lifted out of engagement with deck 13 and rotated 90 degrees about a vertical axis to align ribs 19 with lower surfaces 37. Block 11 is re-engaged with the work surface of deck 13, and the user moves block 11 back and forth along a direction parallel to ribs 19 and perpendicular to the previous sanding direction. Sanding is continued in both directions until the desired shape and smoothness of surfaces 35, 37, 39, 41, 43, 45, 47 are achieved. Though described for sanding, the same steps are used when polishing surfaces such as that on deck 13.

Figure 5:
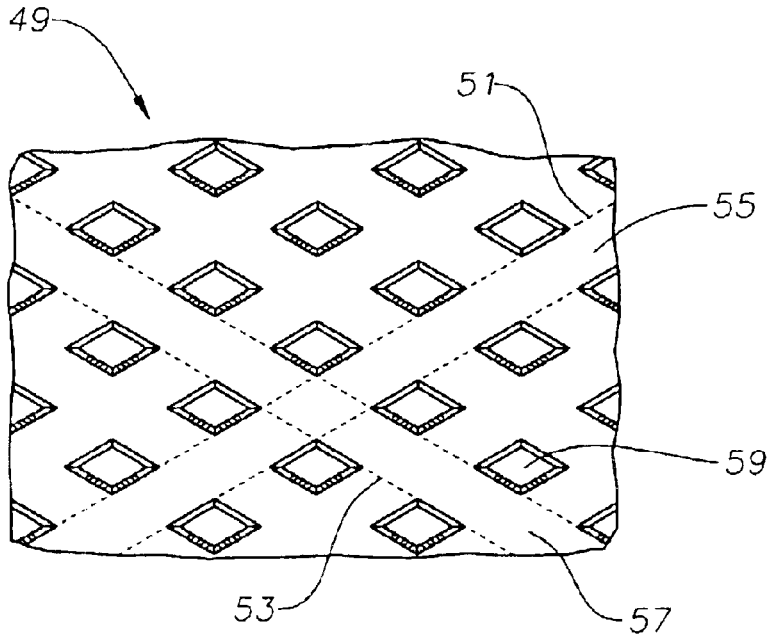
FIG. 5 is a top plan view of work surface having a second surface pattern.

FIG. 5 shows a deck 49 having a second typical work surface pattern. Recesses 51, 53 are formed in the upper surface of deck 49, with lower surfaces 55, 57 defining segments 59. Recesses 51, 53 and lower surfaces 55, 57 are not perpendicular, causing segments 59 to have a diamond shape in plan view. A dressing block (not shown) is formed to have ribs that are spaced at the same distance and have the same width as surfaces 55, 57. Recesses between the ribs of the block are the width of segments as measured perpendicular to recesses 51, 53 for receiving segments 59. The inclined surfaces of the ribs are also formed to have identical angles of inclination as the sidewalls of the recesses 51, 53. Deck 49 is sanded in the same manner as described above for deck 13, with the dressing block being engaged with the work surface and moved back and forth in directions parallel to the ribs and the aligned lower surfaces 55, 57.

The present invention has several advantages. Dressing blocks of the invention provide for the ability to effectively sand work surfaces when repairing or installing the surfaces. Use of the blocks allows for simultaneous sanding of all of parallel, exposed surfaces of the pattern of the work surface, and then the block is rotated to sand the remaining surfaces. The dressing block is easy to use and easily formed from a rigid material, such as metal.

While the invention has been shown in only one of its forms, it is not thus limited but is susceptible to various changes and modifications without departing from the spirit thereof.

What is claimed is:

1. A method for dressing a work surface having a pattern of protuberances separated by a first set of parallel recesses that intersect a second set of parallel recesses, comprising:

providing a dressing block with an abrasive surface having a plurality of parallel ribs;

sliding the dressing block on the work surface in a first direction along the first set of parallel recesses; and sliding the dressing block on the work surface in a second direction along the second set of recesses.

* * * * *